US011104976B2

(12) United States Patent
Yoon et al.

(10) Patent No.: US 11,104,976 B2
(45) Date of Patent: Aug. 31, 2021

(54) BI-CONTINUOUS COMPOSITE OF REFRACTORY ALLOY AND COPPER AND METHOD FOR MANUFACTURING THE SAME

(71) Applicant: Seoul National University R&DB Foundation, Seoul (KR)

(72) Inventors: Kooknoh Yoon, Seoul (KR); Il-Hwan Kim, Seoul (KR); Hyun Seok Oh, Seoul (KR); Sang Jun Kim, Seoul (KR); Eun Soo Park, Suwon-si (KR)

(73) Assignee: SEOUL NATIONAL UNIVERSITY R&DB FOUNDATION, Seoul (KR)

( * ) Notice: Subject to any disclaimer, the term of this patent is extended or adjusted under 35 U.S.C. 154(b) by 342 days.

(21) Appl. No.: 15/893,862

(22) Filed: Feb. 12, 2018

(65) Prior Publication Data

US 2019/0040495 A1 Feb. 7, 2019

(30) Foreign Application Priority Data

Aug. 3, 2017 (KR) ..... 10-2017-0098450

(51) Int. Cl.
*C22C 30/00* (2006.01)
*C22C 27/02* (2006.01)
(Continued)

(52) U.S. Cl.
CPC ..... *C22C 1/02* (2013.01); *C22C 27/00* (2013.01); *C22C 27/02* (2013.01); *C22C 27/025* (2013.01);
(Continued)

(58) Field of Classification Search
CPC ..... C22C 27/00; C22C 30/02; C22C 27/04; C22C 27/02; C22C 30/00; C22C 9/00; C22C 27/025; C22C 27/06
See application file for complete search history.

(56) References Cited

U.S. PATENT DOCUMENTS 4,378,330 A * 3/1983 Verhoeven ..... C22C 9/00 257/E39.006
4,600,448 A * 7/1986 Schmidt ..... C22C 9/00 148/407

(Continued)

OTHER PUBLICATIONS

I. Smid et al., "Development of tungsten armor and bonding to copper for plasma-interactive components" Journal of Nuclear Materials 258-263, pp. 160-172, Oct. 1998.

(Continued)

*Primary Examiner* — Anthony J Zimmer
*Assistant Examiner* — Sean P. O'Keefe
(74) *Attorney, Agent, or Firm* — Lex IP Meister, PLLC

(57) ABSTRACT

A bi-continuous composite of a refractory alloy and copper, and a method for manufacturing the same, are provided. The method for manufacturing a bi-continuous composite of a refractory alloy and copper includes: providing an alloy melt swapping (AMS) precursor; providing a copper melt with a temperature in a range of 1085° C. to 3410° C.; immersing the AMS precursor into the copper melt; and removing the AMS precursor from the copper melt. The AMS precursor includes elements having positive and negative mixing enthalpy with copper, respectively. The AMS precursor into which the copper melt is diffused becomes a bi-continuous composite with a first phase formed from the copper and a second phase formed from the AMS precursor.

4 Claims, 12 Drawing Sheets

(51) Int. Cl.

| | |
|---|---|
| ***C22C 27/04*** | (2006.01) |
| ***C22C 30/02*** | (2006.01) |
| ***C22C 27/00*** | (2006.01) |
| ***C22C 27/06*** | (2006.01) |
| ***C22C 1/02*** | (2006.01) |

(52) U.S. Cl.
CPC ..... *C22C 27/04* (2013.01); *C22C 27/06* (2013.01); *C22C 30/00* (2013.01); *C22C 30/02* (2013.01)

(56) References Cited

U.S. PATENT DOCUMENTS

| | | | | |
|---|---|---|---|---|
| 4,626,282 | A * | 12/1986 | Naya | H01H 1/0203 200/265 |
| 5,252,147 | A * | 10/1993 | Verhoeven | C23C 26/02 148/237 |
| 7,128,980 | B2 | 10/2006 | Schedler et al. | |
| 2011/0114285 | A1* | 5/2011 | Buxbaum | F28F 21/085 165/51 |
| 2015/0057144 | A1* | 2/2015 | Erlebacher | C22C 14/00 501/96.1 |

OTHER PUBLICATIONS

A.v. Müller et al., "Melt infiltrated tungsten-copper composites as advanced heat sink materials for plasma facing components of future unclear fusion devices", Fusion Engineering and Design 124, pp. 455-459, Nov. 2017.

* cited by examiner

BI-CONTINUOUS COMPOSITE OF REFRACTORY ALLOY AND COPPER AND METHOD FOR MANUFACTURING THE SAME

CROSS-REFERENCE TO RELATED APPLICATION

This application claims priority to and the benefit of Korean Patent Application No. 10-2017-0098450 filed in the Korean Intellectual Property Office on Aug. 3, 2017, the entire contents of which are incorporated herein by reference.

BACKGROUND OF THE INVENTION

(a) Field of the Invention

The present invention relates to a bi-continuous composite of a refractory alloy and copper, and a method for manufacturing the same. In particular, the composite includes a first phase of copper with high thermal conductivity and a second phase of a refractory alloy with high strength and low activation. The composite is prepared by immersing an alloy melt swapping (referred to as "AMS" hereinafter) precursor into a copper melt and then swapping positions of elements of the alloying elements constituting the precursor and the copper by diffusion. The alloying elements constituting the precursor are selected according to its thermodynamic relationship with the copper.

(b) Description of the Related Art

As diverse researches in an ultra-high temperature environment such as high efficiency power generation and outer space have proceeded, new materials capable of being used in such environment have also been required. In particular, conventional materials used in a high temperature environment not only have a problem in abrupt reduction in yield strength above a particular temperature, but also have a difficulty in prompt thermal emission due to very low thermal conductivity. Thus, it is difficult for the materials to secure stability of their entire structure.

In case of a nuclear fusion reactor as a typical example of an apparatus used in an extreme environment, plasma facing components (referred to as "PFC" hereinafter) has been especially contrived and used for preventing impurities from being created and then decreasing purity of core plasma. The impurities are created by a phenomenon in which plasma particles collide with an inner wall of the nuclear fusion reactor during operation of the nuclear fusion reactor. A diverter is a main device of the nuclear fusion reactor by which the impurities in the nuclear reactor core are removed to minimize contamination of the plasma. The diverter protects a vacuum vessel and a diagnostic device from the high temperature plasma. The material of the diverter plays an important role because it leads leaked plasma ions or electron impurity ions to be far away from the plasma by setting a magnetic flux contacting with an external system near the plasma.

Meanwhile, the material of the diverter should have good cooling characteristics in order to be stably used at a high temperature. The material should also have high thermal conductivity. Its bonding characteristics between the PFC and a cooling part of a CuCrZr alloy have been importantly spotlighted. Thus, it is difficult to secure the characteristics of the diverter located in the nuclear fusion reactor exposed to a particularly extreme environment without improving the bonding properties of the cooling part and the PFC with high thermal conductivity. Thus, manufacturing of the composite of the copper and the refractory alloy is a prerequisite.

To solve these problems, various composites have been developed and used. In particular, a composite manufactured by infiltrating copper into a porous metal produced by sintering a refractory alloy such as tungsten under high temperature and pressure has been utilized in various fields. The copper has high thermal conductivity, while the refractory alloy can be tungsten with high strength and low activation. Although this method has an advantage in that a copper fraction of the composite can be easily controlled by controlling porosity, it is not easy to apply it to a W-monoblock structure that is widely used for the diverter material. Furthermore, mechanical performance of the material at a high temperature is deteriorated due to a fracture toughness reduction of the bonding portion induced by forming of mismatched interfaces between tungsten and copper caused by an involuntary process of infiltration. The mechanical performance is also made worse due to an abrupt yield strength reduction at a high temperature. In this regard, new technology development is required.

SUMMARY OF THE INVENTION

The method for manufacturing a bi-continuous composite of a refractory alloy and copper includes: providing an alloy melt swapping (AMS) precursor; providing a copper melt with a temperature in a range of 1085° C. to 3410° C.; immersing the AMS precursor into the copper melt; and removing the AMS precursor from the copper melt. The AMS precursor includes elements having positive and negative mixing enthalpy with copper, respectively. The AMS precursor into which the copper atoms are diffused becomes a bi-continuous composite with a first phase formed from the copper and a second phase formed from the AMS precursor.

In the providing of the AMS precursor, the AMS precursor may have a chemical composition of $A_{100-x}B_x$ (where A is at least one metal selected from a group of elements I including Ti, Zr, and Hf, while B is at least one metal selected from a group of elements II including V, Cr, Mo, Nb, Ta, and W, and 5 at %≤x≤95 at %). In the immersing of the AMS precursor into the copper melt, the second phase is formed from the B. In the immersing of the AMS precursor into the copper melt, the composite may have a chemical composition of $Cu_{100-y}B_y$ (where 5 at %≤y≤95 at %). In the providing of the AMS precursor, the AMS precursor may be a complete solid solution. In the providing of the copper melt, the temperature may be in a range of 1200° C. to 1800° C. In the immersing of the AMS precursor into the copper melt, the AMS precursor may be immersed for 1 min to 240 h. The method for manufacturing the bi-continuous composite may further include reusing the copper melt for manufacturing another bi-continuous composite.

A bi-continuous composite of a refractory alloy and copper has a chemical composition of $Cu_{100-x}B_x$ (where B is at least one metal selected from a group of elements II including V, Cr, Mo, Nb, Ta, and W, and 5 at %≤x≤95 at %). The composite may include dendrites and at least one interdendritic region located between the dendrites, and an amount of the Cu at the interdendritic region is greater than the amount of the Cu at the dendrites. The amount of the Cu at the interdendritic region may not be less than 90 at % and less than 100 at %. An amount of the B at the dendrites may be greater than the amount of the B at the interdendritic region.

DETAILED DESCRIPTION

Figure 1A:
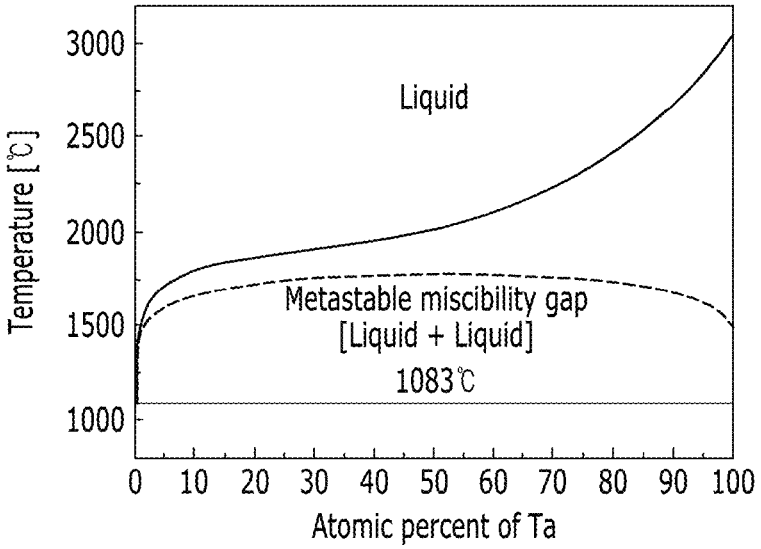
FIG. 1A is a binary phase diagram of Ta and Cu.

Hereinafter, the present invention will be described more fully with reference to the accompanying drawings, in which exemplary embodiments of the invention are shown. As those skilled in the art would realize, the described embodiments may be modified in various different ways, all without departing from the spirit or scope of the present invention. Advantages and characteristics of the technical disclosure and methods for achieving them should become apparent with reference to exemplary embodiments described in detail below in addition to the accompanying drawings. However, the scope of the disclosure is not limited to the exemplary embodiments which will be described below, and may be implemented in various forms. Throughout the specification, like elements refer to like reference numerals. Detailed description of the well-known prior art is omitted.

It will be understood that, although the terms first, second, etc., may be used herein to describe various elements, these elements should not be limited by these terms. These terms are only used to distinguish one element from another. As used herein, the singular forms "a", "an", and "the" are intended to include the plural forms as well, unless the context clearly indicates otherwise. In addition, when a unit "comprises" an element, the unit does not exclude another element but may further include another element unless the context clearly indicates otherwise.

As a new material which is sustainable under the extreme environment, the composite having high thermal conductivity and a good bonding property with a material of a cooling part is provided. The composite includes copper and a refractory alloy with low activation such as tungsten. The conventional refractory alloy, which is considered as a material for an inverter in a nuclear fusion reactor, is not suitable for a complicated design and in bonding characteristics to the cooling part due to its high melting point. On the contrary, the composite with an alloy including low activation elements and the copper is provided as the material for the diverter with improved cooling efficiency which is impossible to be realized by using a present material technology. The composite has improved high thermal conductivity and bonding characteristics with the cooling part.

Figure 1B:
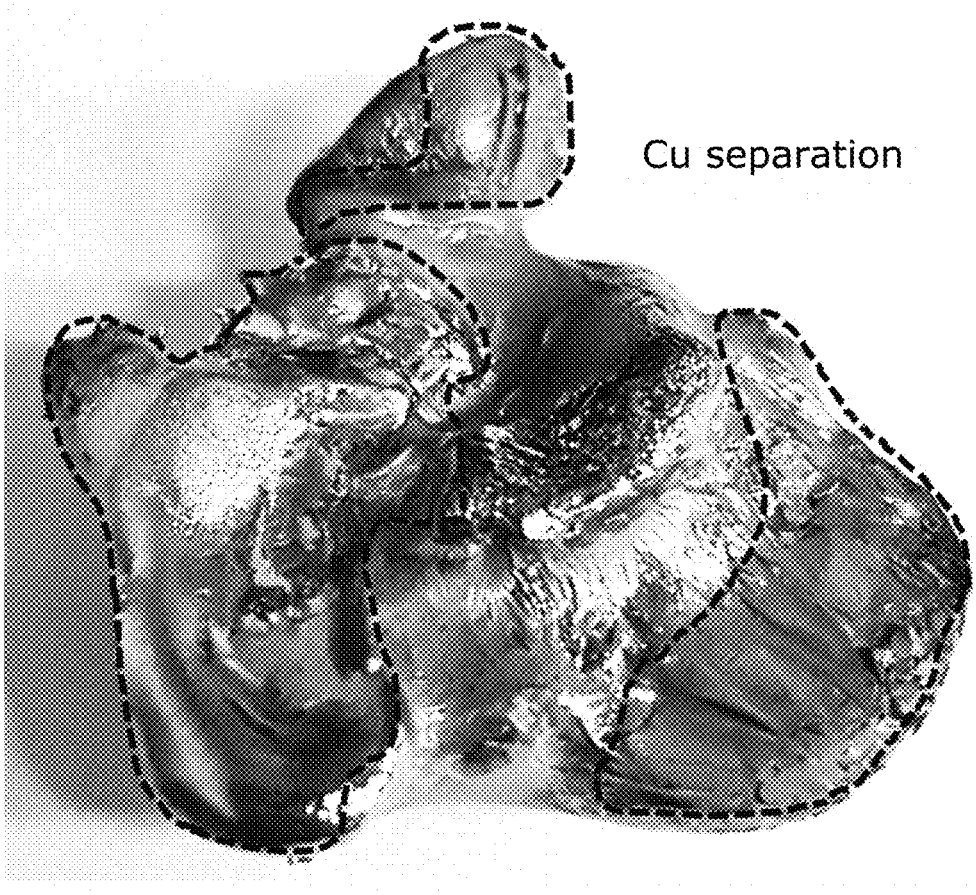
FIG. 1B is a photo of an alloy of Ta and Cu made by an arc melting process.

FIG. 1A is a binary phase diagram of Ta and Cu, and FIG. 1B is a photo of an alloy of Ta and Cu formed by an arc melting process. The amounts of Ta and Cu are the same.

Elements for a refractory alloy not only have great positive mixing enthalpy with the copper, but also have a big difference in density and melting point with the copper. Thus, a composite structure is known to be impossible to be formed by a general casting process such as arc melting, induction melting process and so on.

As shown in FIG. 1A, there is an essential liquid miscibility gap between Ta and Cu with positive mixing enthalpy of +2 kJ/mol, thereby they are expected to be voluntarily separated during a solidifying process. Furthermore, since the refractory alloy is higher than the copper in density, extreme layer separation occurs along a gravity direction. In fact, as shown in FIG. 1B, although temperature of arc plasma is high enough to melt each element, the two alloying elements are not alloyed well, thereby being extremely separated.

AMS Process and Classification of Elements

In order to solve the above problems, a bi-continuous composite of a first phase of high thermal conductivity and a second phase of high strength and low activation is manufactured by the AMS process. A result and a manufacturing method are systematically explained below.

First, three kinds of alloying elements having a special thermodynamic relationship with each other should be prepared. Element C is necessary to be used as a liquid melt immersing the AMS precursor A+B which is used to form a composite. The precursor can easily form a composite structure of B+C by a process using a special mixing enthalpy relationship with the alloy melt C. That is, a refractory alloy should include alloyed element groups having a specific mixing enthalpy relationship with the copper melt. The element group I (A) and the element group II (B) are defined to have positive and negative mixing enthalpies with the copper, respectively. The AMS precursor includes both of the element groups A and B. When the precursor is immersed into a high temperature copper melt, elements with positive mixing enthalpy remain and those with negative mixing enthalpy are guided to be dissolved out by exchanging positions by diffusion.

Figure 2:
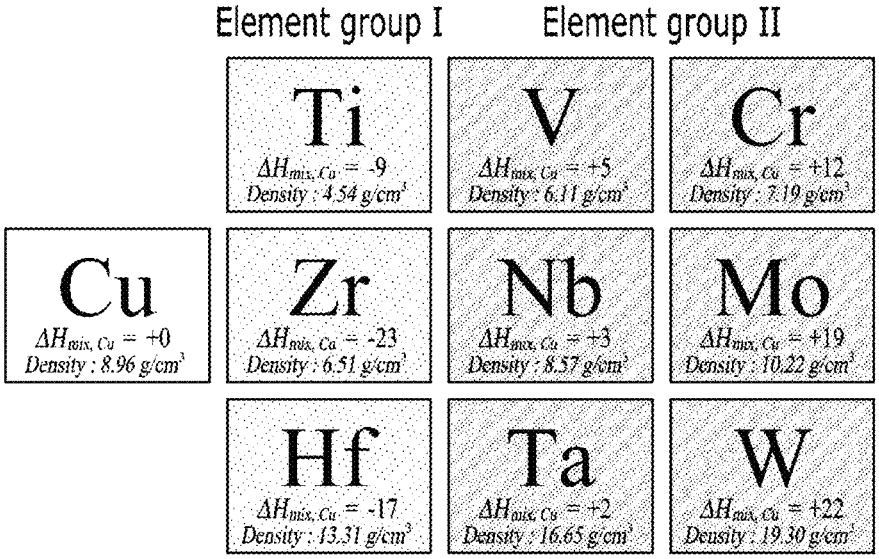
FIG. 2 schematically shows element groups I and II with mixing enthalpy and density for forming the AMS precursor.

FIG. 2 schematically shows element groups I and II with mixing enthalpy and density for forming the AMS precursor. The element group I represents alloying elements having negative mixing enthalpy with copper. The element group II represents alloying elements having positive mixing enthalpy with copper to form a second phase of the composite. In addition, the room temperature density of the alloying elements is also described in FIG. 2.

Manufacturing of the AMS Precursor

The AMS precursor is supposed to be immersed into a hot copper melt. The AMS precursor includes element groups I and II having negative and positive mixing enthalpy relationships with the copper, respectively. The AMS precursor is manufactured by arc melting. Since a high temperature can be achieved by the arc plasma in the arc melting, a uniformly bulked solid solution can be promptly manufactured and impurities such as oxides and pores can be minimized. In addition to the arc melting, high frequency induction melting with a stirring effect by using an electromagnetic field, resistance heating capable of precisely controlling temperature, and quenching for favorably forming a complete solid solution can also be used. Furthermore, a powder sintering process under a high temperature or pressure such as spark plasma sintering or hot isostatic pressing can be used. The power sintering process has an advantage in precisely controlling microstructure and easily manufacturing parts with a desired shape. The AMS precursor can also have gone through cold and hot rolling, and heat treatment for recrystallization. Meanwhile, if the AMS precursor does not form a single phase, it cannot be used because the AMS precursor should replace some of its elements with the copper.

Figure 3:
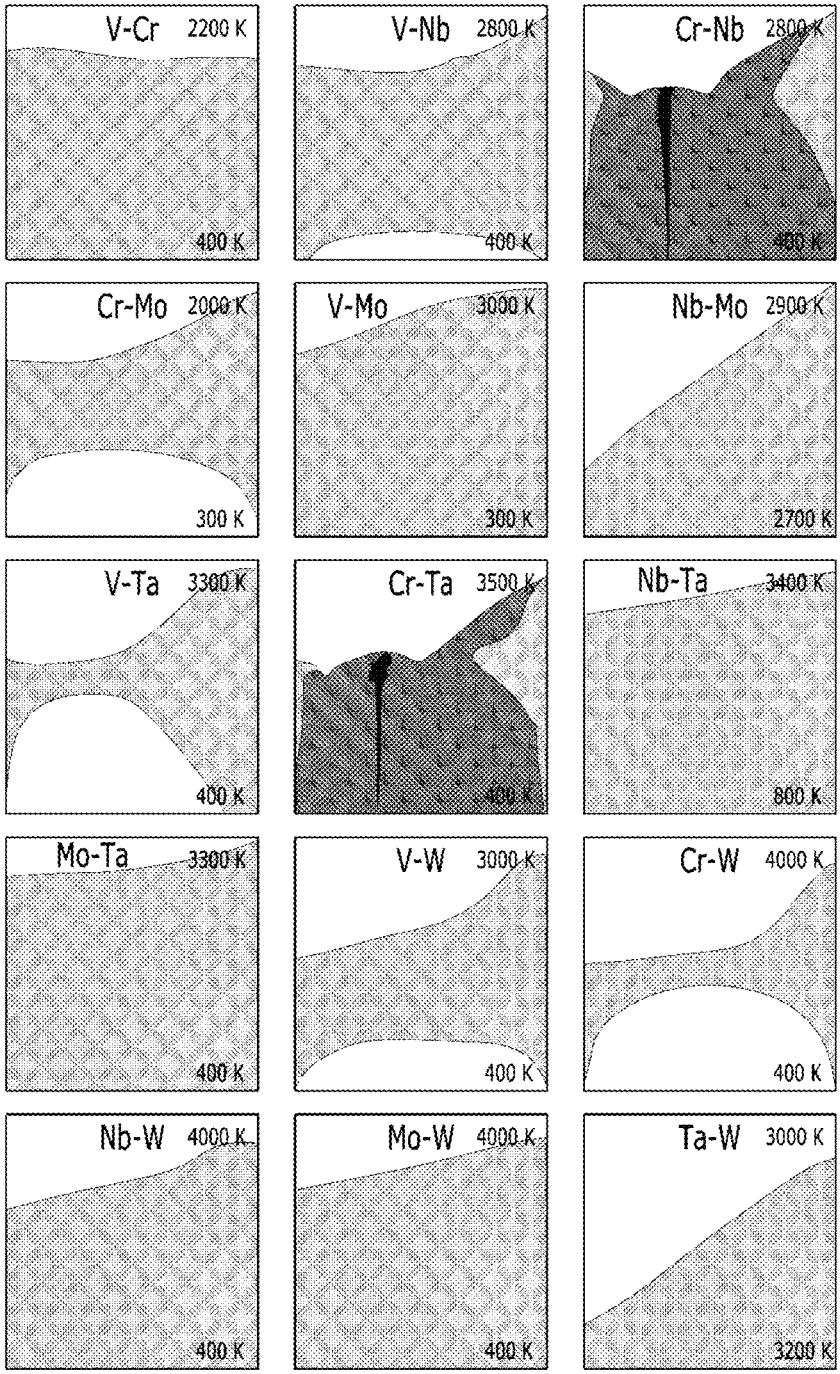
FIG. 3 is a schematic diagram showing a complete solid solution range in a binary phase diagram between elements of element group II.

FIG. 3 is a schematic diagram showing a complete solid solution range in a binary phase diagram between elements of element group II. The light gray area represents an area in which each alloy forms a complete solid solution with a body centered cubic (BCC) phase, while the black areas in phase diagrams of Cr—Nb and Cr—Ta represent a Laves phase which is a stable precipitation formed in a specific composition ratio.

The elements of element group II have positive mixing enthalpy with the copper to be formed as a second phase. The elements of element group II have a body centered cubic structure. If the AMS precursor has multiple phases or includes a thermodynamically stable intermetallic compound, a composite with a desired uniform microstructure might not be formed since a reaction with the copper melt does not uniformly occur over the entire area. In this regard, a single phase with a complete solid solution is preferable.

As shown in the light gray area of FIG. 3, even when most of the alloys are manufactured with a certain fraction, a solid solution phase is stably formed to be easily alloyed. Also, as shown in the black area of FIG. 3, a stable phase is precipitated only in a limited composition ratio and the solid solution with a body centered cubic phase can exist over most of the composition range. In particular, the AMS precursor is high in forming a single solid solution without any precipitation since mixing entropy is raised by alloying a variety of major elements of the AMS precursor.

A single solid solution phase can be obtained even when the AMS precursor is manufactured by alloying six elements of element group II with any ratio. This phenomenon was verified by high entropy alloy compositions having a body centered cubic crystal structure in a variety of advanced researches. In order to verify this phenomenon, alloys with various compositions were manufactured and their crystal structures were analyzed as shown in Table 1 below. Alloying elements only included in the element group II were tested in Table 1. As shown in Table 1, they had a single phase solid solution with a BCC structure. This phenomenon can be easily deduced from the result of the phase stability of the previous studies on BCC high entropy alloys.

TABLE 1

| No | Exemplary Examples | Composition | Crystal Structure |
|---|---|---|---|
| 1 | Comparative Example 1 | W | BCC |
| 2 | Comparative Example 2 | $W_{90}Ta_{10}$ | BCC |
| 3 | Comparative Example 3 | $W_{50}Ta_{50}$ | BCC |
| 4 | Comparative Example 4 | $W_{33.3}Ta_{33.3}V_{33.3}$ | BCC |
| 5 | Comparative Example 5 | $W_{25}Ta_{25}V_{25}Cr_{25}$ | BCC |
| 6 | Comparative Example 6 | $W_{40}Ta_{20}V_{20}Cr_{10}Mo_{10}$ | BCC |
| 7 | Comparative Example 7 | $W_{40}Ta_{20}V_{20}Cr_{10}Nb_{10}$ | BCC |
| 8 | Comparative Example 8 | $W_{40}Ta_{20}V_{20}Mo_{10}Nb_{10}$ | BCC |

Meanwhile, at least one alloying element as the AMS precursor is selected from an element group I of Ti, Zr, and Hf. The alloying elements have negative mixing enthalpy with the copper and thermodynamic characteristics that are similar to each other as 4B elements.

Figure 4:
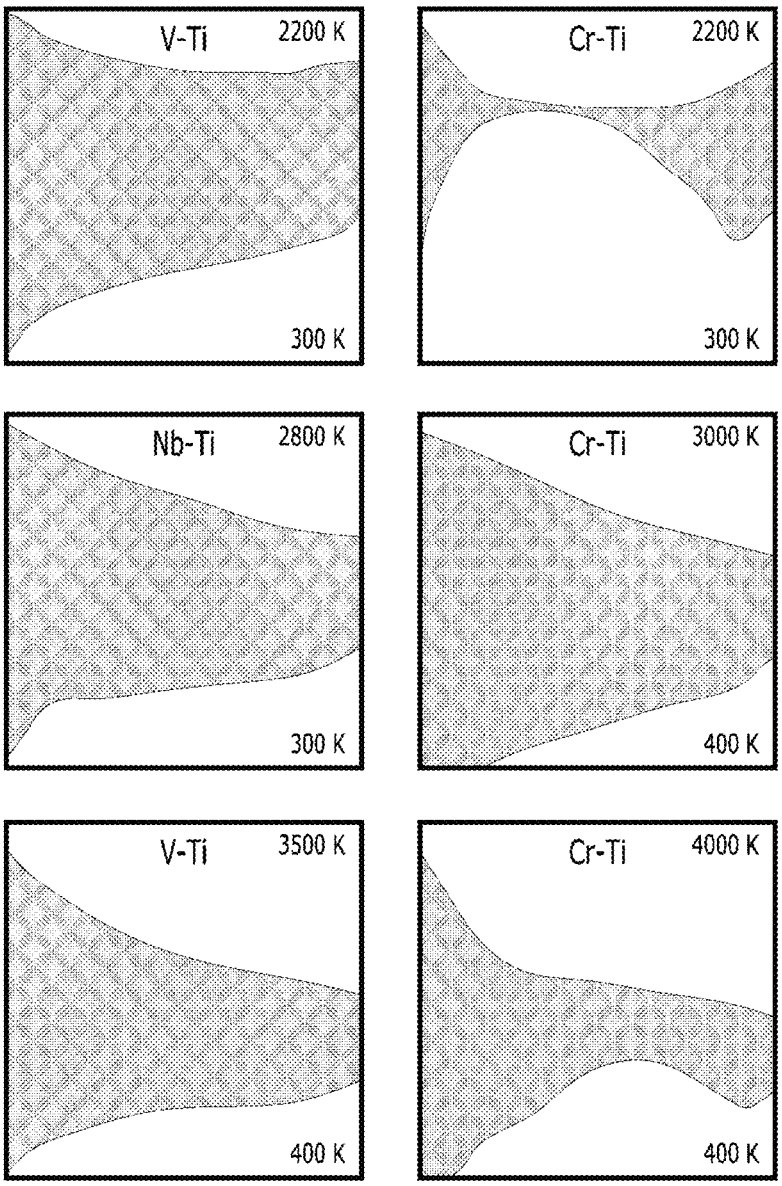
FIG. 4 is a schematic diagram showing a complete solid solution range in a binary phase diagram of Ti as a representative element of an element group I and an element of element group II.

FIG. 4 is a schematic diagram showing a complete solid solution area in a binary phase diagram of Ti and an element of element group II. Ti is a representative element of element group I. The light gray colored area is a composition in which a complete solid solution with a BCC structure can be formed.

As shown in FIG. 4, alloys including elements respectively selected from element groups I and II form a complete solid solution over an entire composition area, and can be used as a good precursor. In this regard, it is proved that there is no problem even when the element group II with any ratio is included in the AMS precursor. This was also systematically verified by Comparative Examples 9 to 15 as shown in Table 2.

TABLE 2

| No | Exemplary Examples | Composition | Crystal Structure |
|---|---|---|---|
| 1 | Comparative Example 9 | $W_{50}Ti_{50}$ | BCC |
| 2 | Comparative Example 10 | $Ta_{50}Ti_{50}$ | BCC |
| 3 | Comparative Example 11 | $W_{33.3}Ta_{33.3}Ti_{33.3}$ | BCC |
| 4 | Comparative Example 12 | $W_{25}Ta_{25}V_{25}Ti_{25}$ | BCC |
| 5 | Comparative Example 13 | $W_{20}Ta_{20}V_{20}Cr_{20}Ti_{20}$ | BCC |
| 6 | Comparative Example 14 | $W_{20}Ta_{20}V_{20}Cr_{20}Hf_{20}$ | BCC |
| 7 | Comparative Example 15 | $W_{20}Ta_{20}V_{20}Cr_{20}Zr_{20}$ | BCC |

As shown in Table 2, an amount of the element group I is in a range of 5 at % to 95 at % of the alloy for manufacturing the AMS precursor. If the amount of the element group I is less than 5 at % or greater than 95 at %, first and second phases can be dissolved into each other during the AMS process, so a composite having a segregated phase cannot be manufactured. To summarize the above-identified description, the composition of the precursor can be described as Formula 1 below.

$$A_{100-x}B_x \quad \text{[Chemical Formula]}$$

Here, 5 at % $\leq x \leq$ 95 at %.

A means elements of the element group I while B means elements of the element group II. The A is a solid solution alloy manufactured to include at least one element from an element group I of Ti, Zr, and Hf, while the B is an alloy including at least one element from an element group II of V, Cr, Nb, Mo, Ta, and W. A refractory alloy solid solution with a BCC structure can be manufactured even if the elements with any ratio are alloyed as described above.

Manufacturing of Bi-Continuous Composite by Using the AMS Process

The bi-continuous composite is manufactured by reacting the AMS precursor with hot copper melt in this step. Since the AMS precursor including refractory alloys and the copper are known to have weak oxidation resistance at a high temperature as shown in the comparative examples, very pure Ar was used as an atmosphere gas in order to stably carry out the AMS process in a long time.

Figure 5:
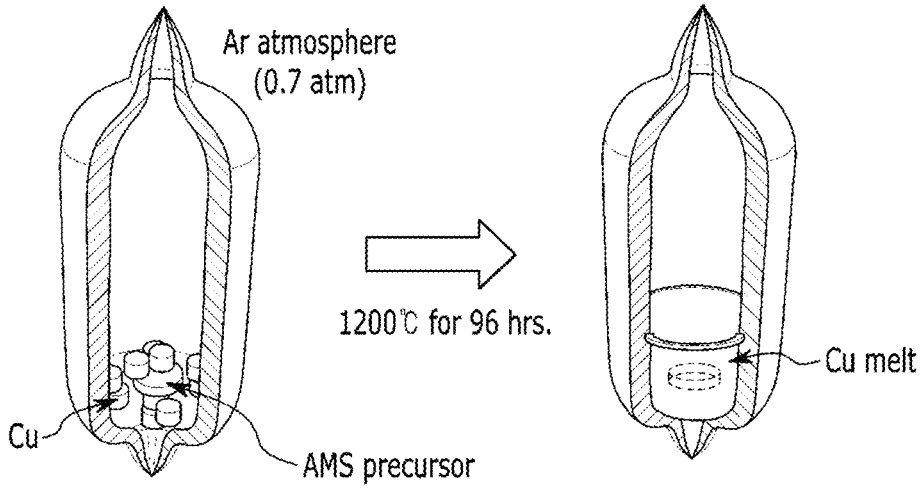
FIG. 5 schematically shows the AMS process of the present invention.

FIG. 5 schematically shows the AMS process of the present invention. As shown in FIG. 5, very pure Ar is used as an atmosphere gas.

After the AMS precursor and copper mother alloy are introduced into a non-reactive silica tube, Ar is charged into the silica tube at 0.7 atm and then sealed in order to prevent oxidation caused by the oxygen. The silica tube is kept in an electric resistance furnace at a high temperature, so only the copper is melted without melting the AMS precursor, and then the reaction is induced.

In order to stably manufacture a copper melt, the source materials can also be melted in a vacuum chamber charged with Ar by using induction melting, which allows the materials to be uniformly dissolved by using a stirring effect by the induced electromagnetic field. Otherwise, other commercial heating processes using a tube furnace in which precise control of temperature and vacuum are easy can be used.

Table 3 shows Exemplary Examples 1 to 10 for manufacturing a bi-continuous composite according to the present invention.

TABLE 3

| No | Exemplary Examples | Composition | Processing time | Processing temp | Crystal structure |
|---|---|---|---|---|---|
| 1 | Exemplary Example 1 | $W_{50}Ti_{50}$ | 96 h | 1200° C. | BCC + FCC |
| 2 | Exemplary Example 2 | $Ta_{90}Ti_{10}$ | 96 h | 1200° C. | BCC + FCC |
| 3 | Exemplary Example 3 | $W_{33.3}Ta_{33.3}Ti_{33.3}$ | 96 h | 1200° C. | BCC + FCC |
| 4 | Exemplary Example 4 | $W_{25}Ta_{25}V_{25}Ti_{25}$ | 96 h | 1200° C. | BCC + FCC |
| 5 | Exemplary Example 5 | $W_{20}Ta_{20}V_{20}Cr_{20}Ti_{20}$ | 96 h | 1200° C. | BCC + FCC |
| 6 | Exemplary Example 6 | $W_{20}Ta_{20}Mo_{20}Nb_{20}Ti_{20}$ | 96 h | 1200° C. | BCC + FCC |
| 7 | Exemplary Example 7 | $W_{20}Ta_{20}V_{20}Cr_{20}Ti_{15}Zr_{5}$ | 96 h | 1200° C. | BCC + FCC |
| 8 | Exemplary Example 8 | $W_{20}Ta_{20}V_{20}Cr_{20}Ti_{15}Hf_{5}$ | 96 h | 1200° C. | BCC + FCC |
| 9 | Exemplary Example 9 | $W_{25}Ta_{25}V_{25}Ti_{25}$ | 24 h | 1200° C. | BCC + FCC |
| 10 | Exemplary Example 10 | $W_{25}Ta_{25}V_{25}Ti_{25}$ | 24 h | 1400° C. | BCC + FCC |

In Exemplary Examples 1 to 10, copper with purity of not less than 99.99% was used as a melt. The processing time and temperature means a time for reacting the AMS precursor with the copper melt at a high temperature and a temperature of the melt, respectively.

In providing the copper melt, the very pure copper, which is known as having high thermal conductivity and bonding characteristics with the cooling part, is prepared as a melt to be formed to be a first phase of the composite. The copper is maintained in a liquid state of high purity and temperature by using a commercial heating method such as induction heating or resistance heating. The first phase is formed of the copper by diffusion and substitution during the AMS process.

The temperature of the copper melt can be controlled in a range of 1085° C. to 3410° C. If the temperature is too low, the diffusion rate of the copper into the AMS precursor is too slow for inducing phase transformation of the AMS precursor in a solid state. In addition, if the temperature is too high, the AMS precursor can be melted. More specifically, the Cr has the lowest melting point among elements of the element group II. In this regard, it is better for the temperature to be greater than half of the melting point of the Cr. In addition, the W has the highest melting point, thereby it is better for the temperature to be less than the melting point of the W. Preferably, the temperature is in a range of 1200° C. to 1800° C. In this temperature range, the copper melt can be stably maintained because the temperature is less than 0.7 times the boiling point of the Cu.

In immersing the AMS precursor into the copper melt, the element group II (B) with negative mixing enthalpy with copper is substituted by the copper. The AMS precursor can be immersed into the copper melt for 1 min to 240 h. If the time for immersing the AMS precursor in the copper melt is less than 1 min or greater than 240 h, the reaction can be deteriorated. Next, the AMS precursor is taken out from the copper melt and can be cooled at room temperature. The AMS precursor can also be quenched in water. Since the hot copper melt is diffused into the AMS precursor, the AMS precursor becomes a bi-continuous composite. This process can be repeated by reusing the used copper melt. The copper melt can be reused for manufacturing another bi-continuous composite.

The bi-continuous composite including the first phase with high thermal conductivity and the second phase with high strength is provided. The refractory alloy, which is formed to be the second phase, can be alloyed with one to six alloying elements for forming the element group II (B) which are known to be capable of forming a solid solution of a body centered cubic structure. The element group I (A), which will be dissolved out by substituting atomic positions through the thermodynamic reaction, is limited to have a range of 5 at % to 95 at % of the AMS precursor. That is, the AMS precursor can have a chemical composition of $A_{100-x}B_x$ (5 at %≤x≤95 at %). If the amount of element group I (A) is less than 5 at % or more than 95 at %, first and second phases are entirely dissolved with each other, and thereby it might be difficult to keep a bi-continuous structure.

Figure 6:
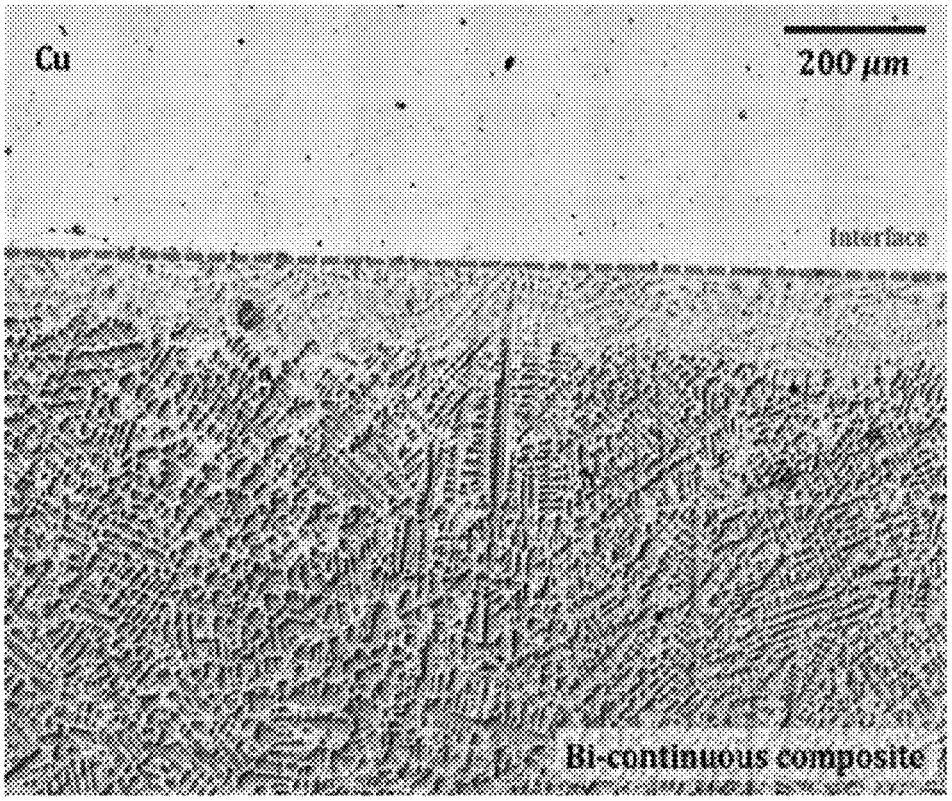
FIG. 6 is an optical microscope image showing a microstructure boundary of the composite manufactured by Exemplary Example 4 and the copper used as a melt.

FIG. 6 is an optical microscope image showing a microstructure boundary of the composite manufactured by Exemplary Example 4 and the copper being used as a melt. Since the copper melt was cooled and solidified, the boundary is formed between the copper and the composite. FIG. 6 shows that the copper is diffused into the AMS precursor in an order of millimeters. The $W_{25}Ta_{25}V_{25}Ti_{25}$ alloy is reacted with the copper melt at 1200° C. for 96 h in order to form a composite, and a surface of the composite was observed by using the optical microscope.

As shown in FIG. 6, a bi-continuous composite with two segregated phases was observed after the AMS process. In the optical microscope image of the composite, a light contrast part indicate a copper rich phase and a dark part is the refractory alloy of a solid solution. The composite with a uniformly distributed structure was observed in FIG. 6, which was impossible to manufacture by using a conventional casting method.

In this case, as verified in FIG. 6, the composite manufactured by the AMS process is expected to be largely scaled up because it can sufficiently react even in an order of a millimeter. In addition, since the process occurs through diffusion by exchanging positions of atoms based on a thermodynamic relationship, a fraction or microstructure of each phase can be controlled as the temperature of the melt, magnetic application, or reaction time is controlled. Furthermore, as shown in FIG. 6, the reaction can be controlled to produce a desired thickness of the composite by controlling a processing time, so a composite with a gradient structure in which the amount of the composite structure is gradually varied can be formed.

A ligament thickness of the first and second phases varies as the temperature of the copper melt is controlled. The ligament thickness of the first and second phases varies as the reaction time of the copper melt is controlled. A microstructure of the composite has a gradual gradient as the amount of the second phase from the surface to the depth direction is controlled as the time of the process for being substituted by the copper melt increases.

Figure 7:
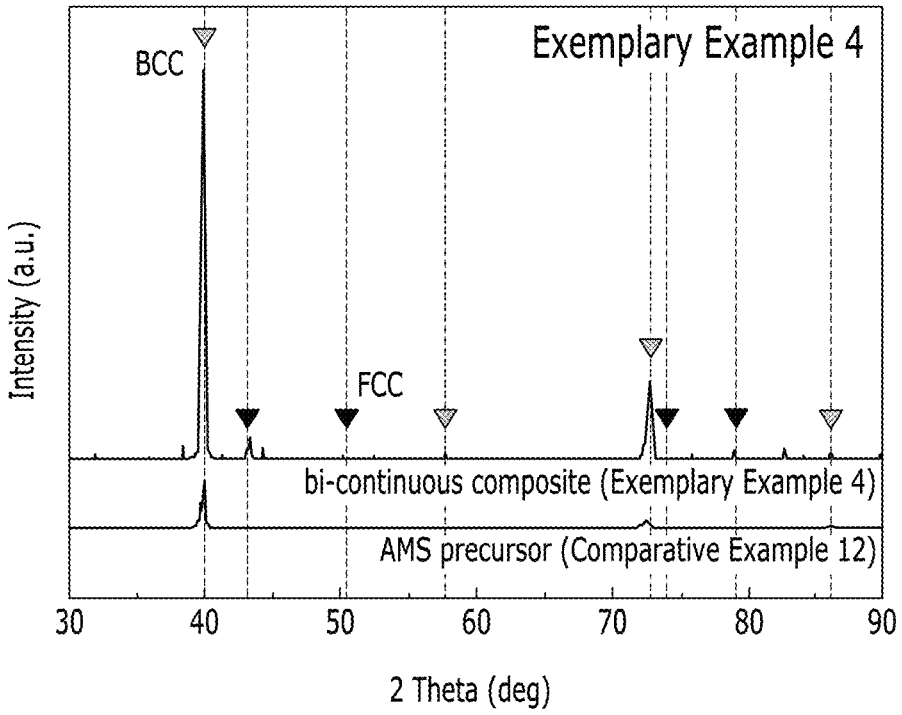
FIG. 7 is an X-ray diffraction graph of the composite manufactured by Exemplary Example 4 and Comparative Example 12.

FIG. 7 is an X-ray diffraction graph of the composite manufactured by Exemplary Example 4 and Comparative Example 12. In Exemplary Example 4, the composite was manufactured in a copper melt by using the AMS process. The formation of the composite structure can be verified in FIG. 7 by the X-ray diffraction of pre-reaction and post-reaction.

As shown in FIG. 7, although the $W_{25}Ta_{25}V_{25}Ti_{25}$ alloy only had a single BCC structure as the AMS precursor, a BCC peak of the refractory alloy is formed together with an FCC peak of the copper after the $W_{25}Ta_{25}V_{25}Ti_{25}$ alloy is sufficiently reacted with the copper melt.

Figure 8:
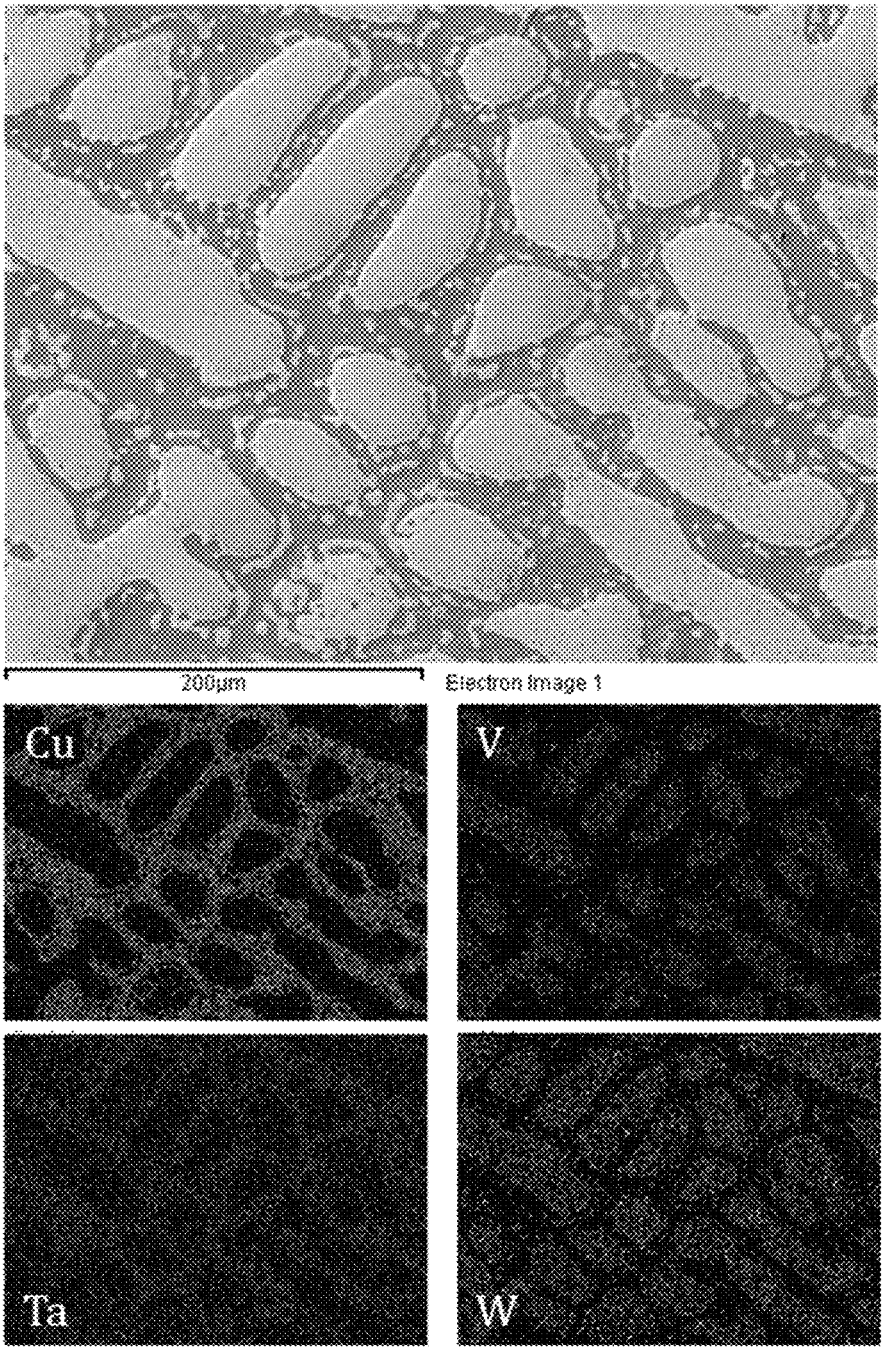
FIG. 8 is scanning electron microscope photograph of the composite manufactured by Exemplary Example 4 and energy dispersive X-ray spectroscopy (EDS) mapping results of each element included in the composite.

FIG. 8 is a scanning electron microscope image of the composite manufactured by Exemplary Example 4 and energy dispersive X-ray spectroscopy (EDS) mapping results of each element included in the composite. The $W_{25}Ta_{25}V_{25}Ti_{25}$ alloy was used in this experiment.

As shown in FIG. 8, the refractory alloy is located in the dendrite area while the copper is located in the interdendritic region. This was verified by the result of analyzing the composition of the composite as described in Table 4 below.

TABLE 4

| NO | Element | Dendrite | Interdendritic region |
|---|---|---|---|
| 1 | Cu | 1.99 at % | 99.15 at % |
| 2 | V | 21.35 at % | 0.14 at % |
| 3 | Ta | 30.88 at % | 0.35 at % |
| 4 | W | 31.45 at % | 0.27 at % |
| 5 | Ti | 14.33 at % | 0.09 at % |

As shown in Table 4, although the same amount of four elements of Ti, V, Ta, and W was used for manufacturing the AMS precursor, the amount of Ti having negative mixing enthalpy to the copper was shown to be much less in the dendrite area than that of other elements. That is, the Ti, which has a reaction of exchanging locations through the AMS process, is sufficiently discharged out to the copper melt and then a copper rich phase be formed therein is induced.

As a result, the composite has a chemical composition of $Cu_{100-x}B_x$ (5 at %≤y≤95 at %), In this chemical composition, the B means element group II. In addition, an amount of the copper at the interdendritic region is much greater than that at the dendrites. The amount of the copper at the interdendritic region is not less than 90 at % and less than 100 at %. Further, an amount of the element group II (B) at the dendrites is greater than that at the interdendritic region.

Figure 9:
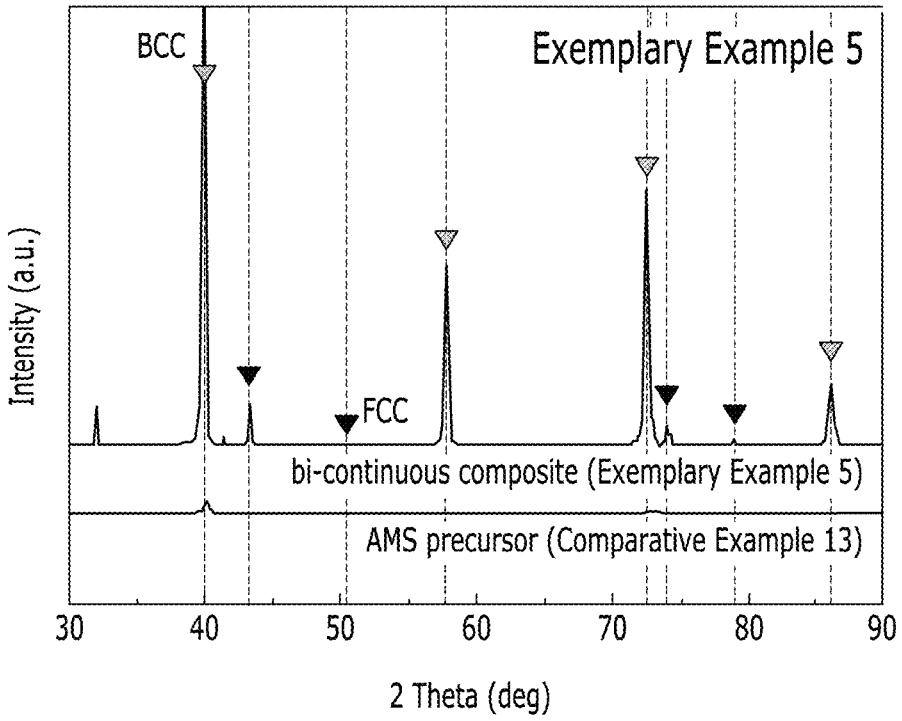
FIG. 9 is an X-ray diffraction graph of the composite manufactured by Exemplary Example 5 and Comparative Example 13.

FIG. 9 is an X-ray diffraction graph of the composite manufactured by Exemplary Example 5 and Comparative Example 13. In FIG. 9, while the quinary $W_{20}Ta_{20}V_{20}Cr_{20}Ti_{20}$ alloy only shows a single BCC crystal structure, the BCC crystal structure of the refractory alloy is formed together with the FCC crystal structure of the copper in Exemplary Example 5 in which locations of the copper and the titanium were exchanged with each other through the sufficient AMS process in the copper melt.

Figure 10:
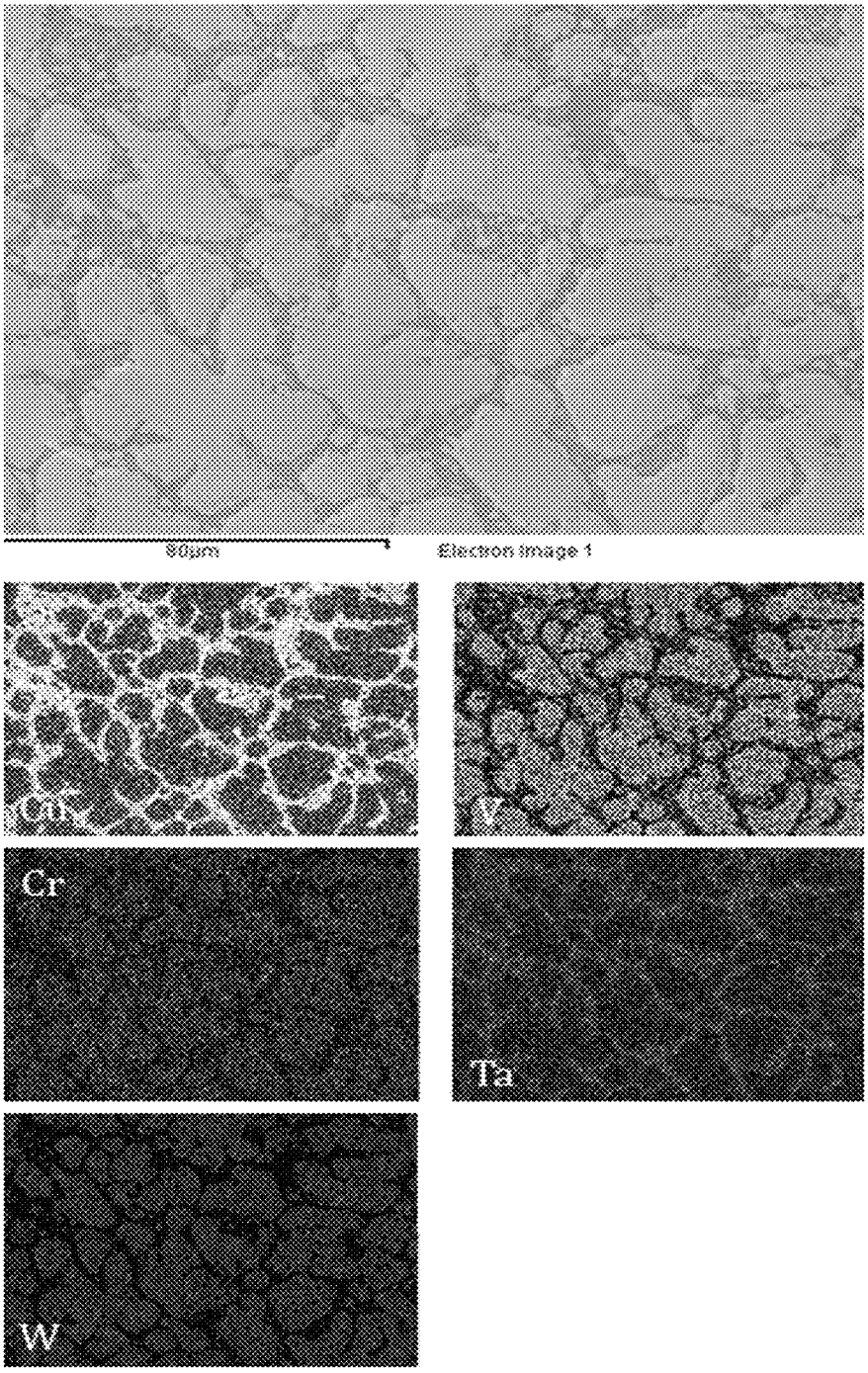
FIG. 10 is scanning electron microscope photograph of the composite manufactured by Exemplary Example 5 and EDS mapping results of each element included in the composite.

FIG. 10 is a scanning electron microscope image of the composite manufactured by Exemplary Example 5 and energy dispersive X-ray spectroscopy (EDS) mapping results of each element included in the composite.

A surface of the composite was analyzed after it has gone through the AMS process. As shown in FIG. 10, Ti, V, Ta, Cr, and W were segregated from the copper and dissolved into the solid solution refractory alloy well. Compositions of each element in dendrite and interdendritic region s were analyzed by using EDS as shown in Table 5 below. As shown in Table 5, the copper remained in the interdendritic region while other elements remained in the dendrite area.

TABLE 5

| NO | Element | Dendrite | Interdendritic region |
|---|---|---|---|
| 1 | Cu | 0 | 99.76 at % |
| 2 | Cr | 8.40 at % | 0.24 at % |
| 3 | V | 10.75 at % | 0 |
| 4 | Ta | 30.63 at % | 0 |
| 5 | W | 40.04 at % | 0 |
| 6 | Ti | 10.18 at % | 0 |

Thermal Conductivity of the Bi-Continuous Composite Manufactured by the AMS Process Thermal conductivity of the bi-continuous alloy was evaluated. The evaluation was done by using a typical laser flash analysis (LFA) method. A thermal diffusion coefficient acquired by using the LFA method is directly proportional to the thermal conductivity. The thermal conductivity is calculated by multiplying specific heat and density at each temperature by the thermal diffusion coefficient.

In Comparative Examples 12 and 13 corresponding to the AMS precursor before the AMS process, thermal conductivities were measured at intervals of 50° C. from room temperature to 850° C. In addition, in Exemplary Examples 4 and 5 corresponding to a composite after the process, thermal conductivities were measured at intervals of 50° C. from room temperature to 700° C. The maximum temperature for measuring the composite of Exemplary Examples 4 and 5 is lowered since inaccurate data might be obtained due to the process. In the process, a measuring chamber is kept under a low pressure and then the materials are reacted at a high temperature which is not less than 70% of the melting point of the copper, 1080° C., so there is a high probability of yielding inaccurate data.

Among all the physical quantities for yielding thermal conductivity except the thermal diffusion coefficient, the density of each alloy is assumed to be constant not above a maximum temperature of 850° C. and Archimedes method was used to yield the result at room temperature. In addition, specific heat of the alloy was calculated by the Kopp-Neumann's rule. According to the Kopp-Neumann's rule, specific heat of the alloy is proportional to a fraction of the elements included in the alloy. In this regard, the specific heat was calculated by multiplying the reported specific heat of each alloy by the fraction of each alloy as a weight based on a confirmed EDS data in a previous step.

Figure 11:
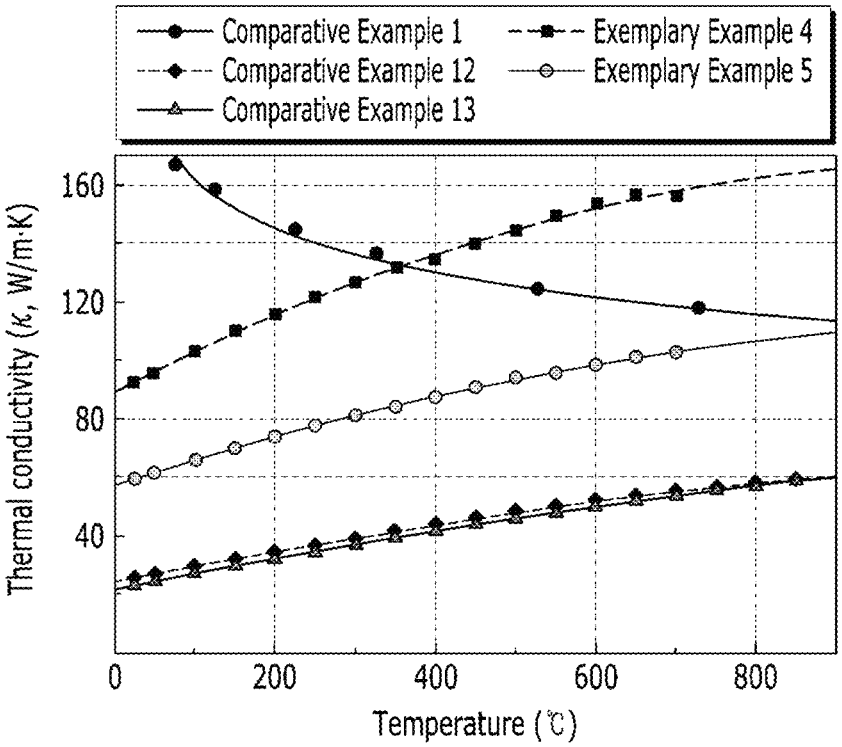
FIG. 11 is a graph showing thermal conductivity versus temperature of Exemplary Examples 4 and 5 and Comparative Examples 1, 12, and 13.

FIG. 11 is a graph showing thermal conductivity versus temperature of Exemplary Examples 4 and 5 and Comparative Examples 1, 12, and 13. The thermal conductivity versus temperature is obtained based on the above-acquired data.

As shown in FIG. 11, thermal conductivity of the pure tungsten of Comparative Example 1 as a representative high thermal conductive metal element and ultra-high temperature material is shown for comparison. The thermal conductivity of the pure tungsten abruptly decreases as the temperature increases. On the contrary, the thermal conductivity of the alloy increases as the temperature increases. This is caused by a decrease of a contribution rate of an electron to the thermal conductivity as the alloy is formed and a lattice distortion effect.

FIG. 11 also shows results of the AMS precursor of Comparative Examples 12 and 13 before the alloys were immersed into the copper melt and those of Exemplary Examples of 4 and 5 after the AMS process was carried out in the copper melt. As shown in FIG. 11, contrary to very low thermal conductivity of the conventional refractory solid solution alloy, the composite including the copper shows high thermal conductivity according to a fraction of the copper. In particular, as the temperature increases, thermal conductivity of the refractory solid solution alloy also increases and then exceeds that of the pure tungsten at a high temperature of not less than 400° C. This characteristic mean that the composite can show higher thermal conductivity in an extreme environment such as an ultra-high temperature. In this regard, the composite is verified to be able to be applied to the material for an environment with ultra-high or ultra-low temperature.

A bonding characteristic of the composite is excellent because the copper phase is uniformly distributed and then the melting temperature difference in the copper based alloy can decrease. Therefore, it can be verified that a bi-continuous composite of a refractory alloy and copper leads to a great improvement of thermal conductivity and bonding characteristics of the composite.

The process is performed by exchanging locations of the elements by diffusion. Thus, the composite with a desired phase or phase fraction can be manufactured by controlling simple processing conditions such as temperature or reaction time, thereby the probability of utilization will be expected to be high.

The composite can replace a conventional W-monoblock type of composite of tungsten and copper used in a diverter. The composite can improve bonding characteristics with a cooling part of the diverter while maintaining high strength and high thermal conductivity, thereby being sustainable against an extreme environment. Since the composite includes the copper uniformly distributed as a second phase, it can drastically improve cooling characteristics of a system by enhancing bonding characteristics of the cooling part and prevent hot deformation by suppressing high temperature yield strength from being abruptly deteriorated. Therefore, the life of the composite can be lengthened.

An alloy with a distinctive structure, which was impossible to be manufactured in a conventional process, can be provided by using the AMS process considering thermodynamic relationships between elements. The composite is voluntarily formed by the distinctive thermodynamic relationship for the AMS process. Thus, mechanical properties of the composite can be enhanced by a stable matched boundary, which is better than those manufactured by a conventional infiltration process. The composition of two phases that are separated by the mixing enthalpy of the relationship can secure optimized purity, such that thermal conductivity of the copper of the first phase can be maximized. In a conventional composite, the composite was difficult to manufacture due to the difference of the alloying elements in density and melting point. On the contrary, the alloying elements in the composite of the present invention can be made uniform, thereby the thermal conductivity and bonding characteristics of the composite can be simultaneously enhanced, which is indispensable to the materials for special purposes such as being used in the diverter and the PFC.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A bi-continuous composite of a refractory alloy and copper having a chemical composition of $Cu_{100-x}B_x$, where B comprises V, Cr, Mo, Nb, Ta, and W, and 5 at %≤x≤95 at %, wherein the bi-continuous composite comprises a face-centered cubic phase and a body-centered cubic phase.

2. The bi-continuous composite of claim 1, wherein the composite comprises dendrites and at least one interdendritic region located between the dendrites, and an amount of the Cu in the interdendritic region is greater than the amount of the Cu in the dendrites.

3. The bi-continuous composite of claim 2, wherein the amount of the Cu in the interdendritic region is not less than 90 at % and less than 100 at % of the total Cu.

4. The bi-continuous composite of claim 2, wherein an amount of the B in the dendrites is greater than the amount of the B in the interdendritic region.

* * * * *